US008022839B2

(12) United States Patent
Goodman

(10) Patent No.: US 8,022,839 B2
(45) Date of Patent: Sep. 20, 2011

(54) TELEMETRY SUBSYSTEM TO COMMUNICATE WITH PLURAL DOWNHOLE MODULES

(75) Inventor: Kenneth R. Goodman, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 828 days.

(21) Appl. No.: 11/830,567

(22) Filed: Jul. 30, 2007

(65) Prior Publication Data

US 2009/0033332 A1 Feb. 5, 2009

(51) Int. Cl.
*G01V 3/00* (2006.01)

(52) U.S. Cl. ..... 340/853.7; 340/855.1

(58) Field of Classification Search ..... 340/853.7, 340/855.5, 855.1; 166/297, 66.6
See application file for complete search history.

(56) References Cited

U.S. PATENT DOCUMENTS

| | | | | |
|---|---|---|---|---|
| 5,691,712 | A | 11/1997 | Meek et al. | |
| 6,173,772 | B1 | 1/2001 | Vaynshteyn | |
| 6,252,518 | B1 * | 6/2001 | Laborde | 340/855.4 |
| 6,550,538 | B1 | 4/2003 | Herrmann et al. | |
| 6,820,693 | B2 | 11/2004 | Hales et al. | |
| 7,152,680 | B2 | 12/2006 | Wilson et al. | |
| 2005/0263281 | A1 | 12/2005 | Lovell et al. | |
| 2007/0029112 | A1 * | 2/2007 | Li et al. | 175/26 |
| 2007/0052551 | A1 * | 3/2007 | Lovell et al. | 340/854.6 |
| 2007/0203648 | A1 * | 8/2007 | Poedjono et al. | 701/301 |

FOREIGN PATENT DOCUMENTS

| | | | |
|---|---|---|---|
| GB | 2352261 | A | 1/2001 |
| GB | 2353308 | A | 2/2001 |
| GB | 2368861 | A | 5/2002 |

* cited by examiner

*Primary Examiner* — Sunil Singh

(74) *Attorney, Agent, or Firm* — Kevin B. McGoff; Rodney V. Warfford; Trop, Pruner & Hu, P.C.

(57) ABSTRACT

A system for use in a wellbore includes plural modules for positioning in the wellbore and including respective interfaces, where the plural modules are configured to perform predefined downhole tasks in the wellbore. The plural modules are associated with respective local power sources. A telemetry subsystem enables communication between at least two of the plural modules, where the communication between the at least two of the plural modules allows one of the two modules to affect an operation of another of the two modules.

20 Claims, 3 Drawing Sheets

TELEMETRY SUBSYSTEM TO COMMUNICATE WITH PLURAL DOWNHOLE MODULES

TECHNICAL FIELD

The invention relates generally to use of a telemetry subsystem to enable communication between plural downhole modules associated with local power sources.

BACKGROUND

To complete a well, various operations are performed downhole in a wellbore. Examples of such operations include firing perforating guns to form perforations in a surrounding formation, setting packers, actuating valves, collecting measurement data from sensors, and so forth. An issue associated with performing such operations with various downhole modules is the ability to efficiently communicate with such downhole modules.

A typical arrangement includes a surface controller that is able to control the operations of the various downhole modules using pressure pulse signals. Alternative techniques of activating downhole modules include techniques that employ hydraulic pressure activation or mechanical activation.

SUMMARY

In general, according to an embodiment, a system for use in a wellbore includes plural modules for positioning in the wellbore and including respective interfaces and being associated with local power sources, where the plural modules are configured to perform predefined downhole tasks in the wellbore. A telemetry subsystem enables communication between at least two of the plural modules, where the communication between the at least two plural modules allows one of the two modules to affect an operation of another of the two modules.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

In accordance with some embodiments, interface circuits are added to downhole modules (positioned in a wellbore) to allow the downhole modules to communicate with each other, as well as with a surface controller that is located at the earth surface. A downhole module is a module that performs downhole tasks in the wellbore. The downhole modules are remotely powered—in other words, the downhole modules include or are associated with respective local power sources. One example of a local power source is a battery. A local power source differs from a power source supplied from the earth surface (such as over an electrical cable). The local power source enables an electrical downhole module to operate even though no power is supply from the earth surface to the downhole module.

Communication between the downhole modules through the interface circuits occurs through a "telemetry subsystem," where the telemetry subsystem can include wires to interconnect the interface circuits, or alternatively, the telemetry subsystem can include components such as routers, switches, and other telemetry circuitry to enable communication between the interface circuits. The ability to communicate between downhole modules allows for one downhole module to communicate information to another downhole module (where the information can include data or commands). Communicating information between downhole modules allows the operation of one downhole module to be affected by information from another downhole module. In this manner, the surface controller does not always have to be involved in activities associated with the downhole modules. Also, one downhole module can condition its operation on another downhole module.

Thus, there are two communication regimes. The first communication regime is between the downhole modules. The second regime is to/from surface from/to the downhole modules.

Figure 1A:
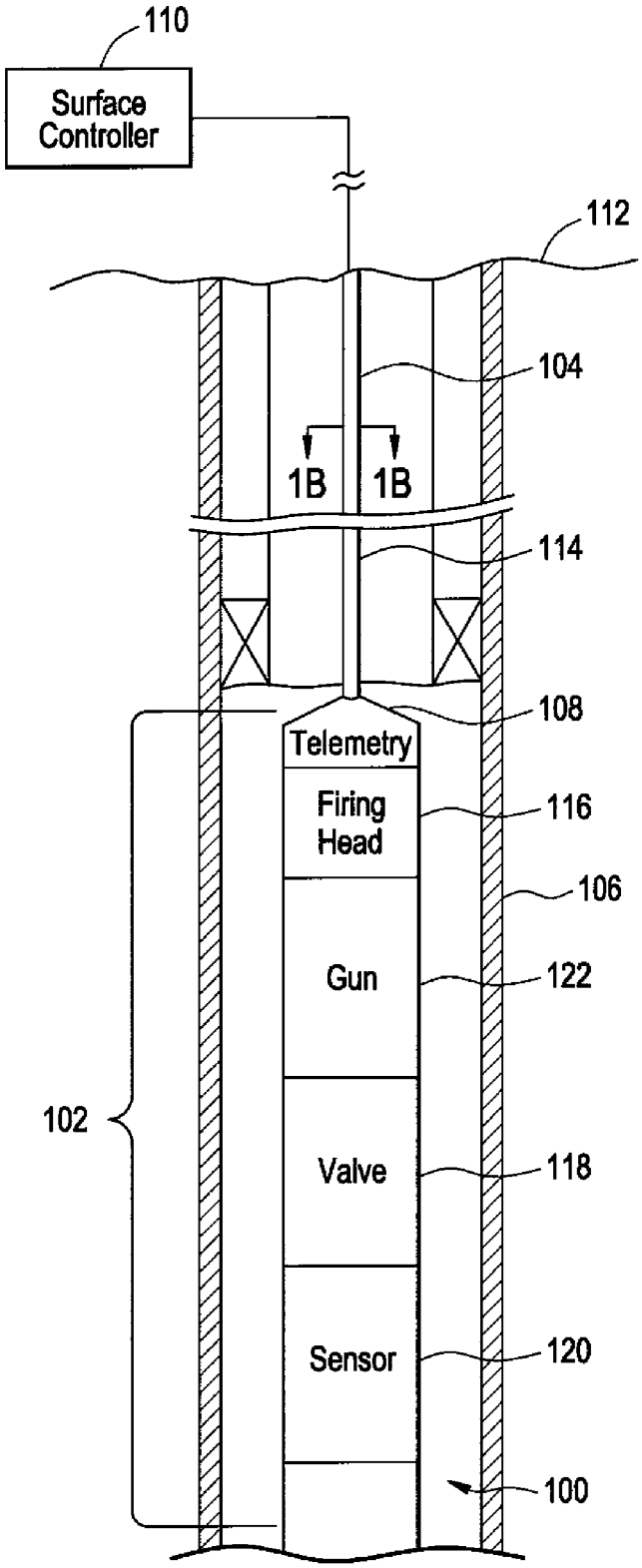
FIG. 1A illustrates a tool string deployed in a well, according to an embodiment.
Figure 1B:
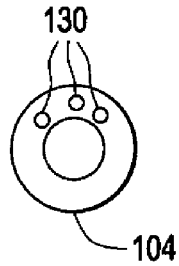
FIG. 1B is a cross-sectional view of a carrier structure in the tool string of FIG. 1A.

FIG. 1A illustrates an example tool string that includes a tool 102 carried on a carrier structure 104 (e.g., tubing or pipe). The tool string is deployed in a wellbore 100 that is lined with casing 106. The tool 102 includes a telemetry subsystem 108 that allows the tool 102 to communicate with a surface controller 110 that is located at an earth surface 112 from which the wellbore 100 extends. The surface controller 10 is used primarily for telemetry, and can be separate from rig pumps that can be used to produce pressure pulse signals that are transmitted downhole. Each of the surface controller 110 and rig pumps can be generally referred to as "surface equipment." The carrier structure 104 can be a wired tubing or wired pipe, in which electrical conductors (e.g., conductors 130 in FIG. 1B) are embedded in the walls of the tubing or pipe. The conductors 130 can extend along the longitudinal length of the tubing or pipe. The embedded conductors enable communication between the surface controller 110 and the telemetry subsystem 108. In an alternative implementation, the telemetry subsystem 108 can communicate with the surface controller 110 (or other surface equipment such as rig pumps) using a wireless technique, such as with electromagnetic (EM) signals, acoustic signals, pressure pulse signals, inductive coupling, and so forth. In yet another implementation, the telemetry subsystem 108 can communicate over a link that includes an optical fiber contained in a tube.

As discussed further below, the telemetry subsystem 108 also communicates with various downhole modules that are part of the tool 102. The downhole modules that can communicate with the telemetry subsystem 108 include a firing head module 116, a valve module 118, and a sensor module 120. Other or alternative modules can also be part of the tool 102 in other implementations. The firing head module 116 is used to fire a perforating gun 122. The valve module 118 includes a valve that is actuatable between an open position, a closed position, and possibly an intermediate position (a partially open position). The sensor module 120 includes one or more sensors to sense various characteristics associated with the wellbore 100 and surrounding formation. As examples, the sensor module 120 can include sensors to detect temperature, pressure, a chemical property, resistivity, and so forth.

The telemetry subsystem 108 allows the various modules of the tool 102 to communicate with the surface controller 110 (or other surface equipment) through the carrier structure 104 (or using wireless communication). Also, according to some embodiments, the telemetry subsystem 108 allows the modules of the tool 102 to communicate with each other.

Figure 2:
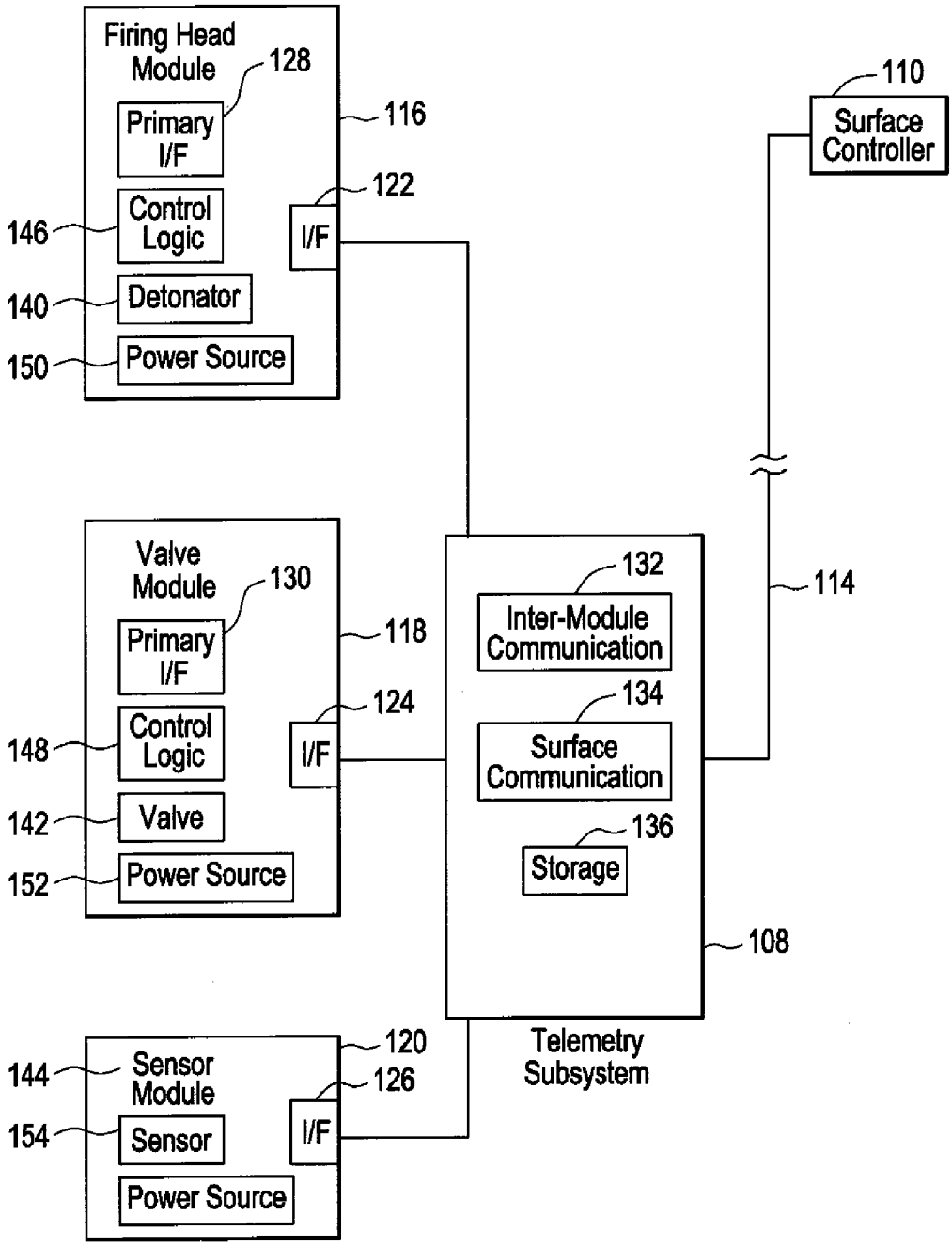
FIG. 2 is a block diagram of an arrangement of modules, according to an embodiment.

FIG. 2 is a block diagram of a communications arrangement that allows the downhole modules 116, 118, and 120 to communicate with each other as well as with the surface controller 110 through the telemetry subsystem 108 and over a link 114. Each of the downhole modules 116, 118, and 120 includes a respective local power source 150, 152, and 154 (e.g., battery). As depicted in FIG. 2, the local power sources 150, 152, and 154 are contained in the respective downhole modules 116, 118, and 120. Alternatively, the local power sources 150, 152, and 154 are located outside the downhole modules 116, 118, and 120.

The downhole modules can have primary interfaces and secondary interfaces. The firing head module 116 includes a detonator 140 that when activated causes the perforating gun 122 (FIG. 1) to fire. The valve module 118 includes a valve 142, and the sensor module 120 includes one or more sensors 144. Activation of the detonator 140 and valve 142 is controlled by control logic 146 and 148 in the modules 116 and 118, respectively. Each of the downhole modules 116, 118, and 120 further has a respective secondary interface 122, 124, and 126 to allow the downhole modules to communicate with the telemetry subsystem 108. The secondary interface 122, 124, 126 can be an electrical interface. Alternatively, the secondary interface can be a different type of interface, such as an optical interface, an inductive coupler interface, a wireless interface, an acoustic interface, and so forth. The secondary interfaces 122, 124, 126 allow for coordination among the downhole modules, or allow for communication with the surface via the telemetry subsystem 108.

At least some of the modules, including the firing head module 116 and valve module 118, can include a respective primary interface 128, 130. The primary interface allows the respective downhole module to receive commands directly from the surface controller 110 or via alternative techniques, such as pressure pulses generated using rig pumps without passing through the telemetry subsystem 108. In one example, the primary interface can be an interface that communicates with pressure pulse signals. Thus, the primary interface 128, 130 can communicate with a sequence of pressure pulses (low-level pressure pulses) that are encoded with signatures to communicate desired information (data and/or commands). One example technique that employs low-level pressure pulse communication is the IRIS technology from Schlumberger. The primary interface 128, 130 includes a pressure sensor and associated electronic circuitry to allow for detection of pressure pulse sequences having corresponding signatures.

In other implementations, the primary interface can communicate using a different mechanism.

Note that the sensor module 120 in the example depicted in FIG. 2 does not include a primary interface to communicate directly with the surface controller. Thus, the sensor module 120 would have to communicate with the surface controller through the telemetry subsystem 108. In an alternative implementation, the sensor module 120 can also be configured with a primary interface to allow direct communication with the surface controller 110.

The telemetry subsystem 108 includes inter-module communication circuitry 132 to allow the downhole modules 116, 118, 120 to communicate with each other. Also, the telemetry subsystem 108 includes surface communication circuitry 134 to allow communication between the telemetry subsystem 108 and the surface controller 110 (or other surface equipment) through the carrier structure 104 (or over a wireless medium). The telemetry subsystem 108 in the example of FIG. 2 can also include a storage 136 to store data or commands that are communicated between the downhole modules or between a downhole module and the surface controller 110.

Figure 3:
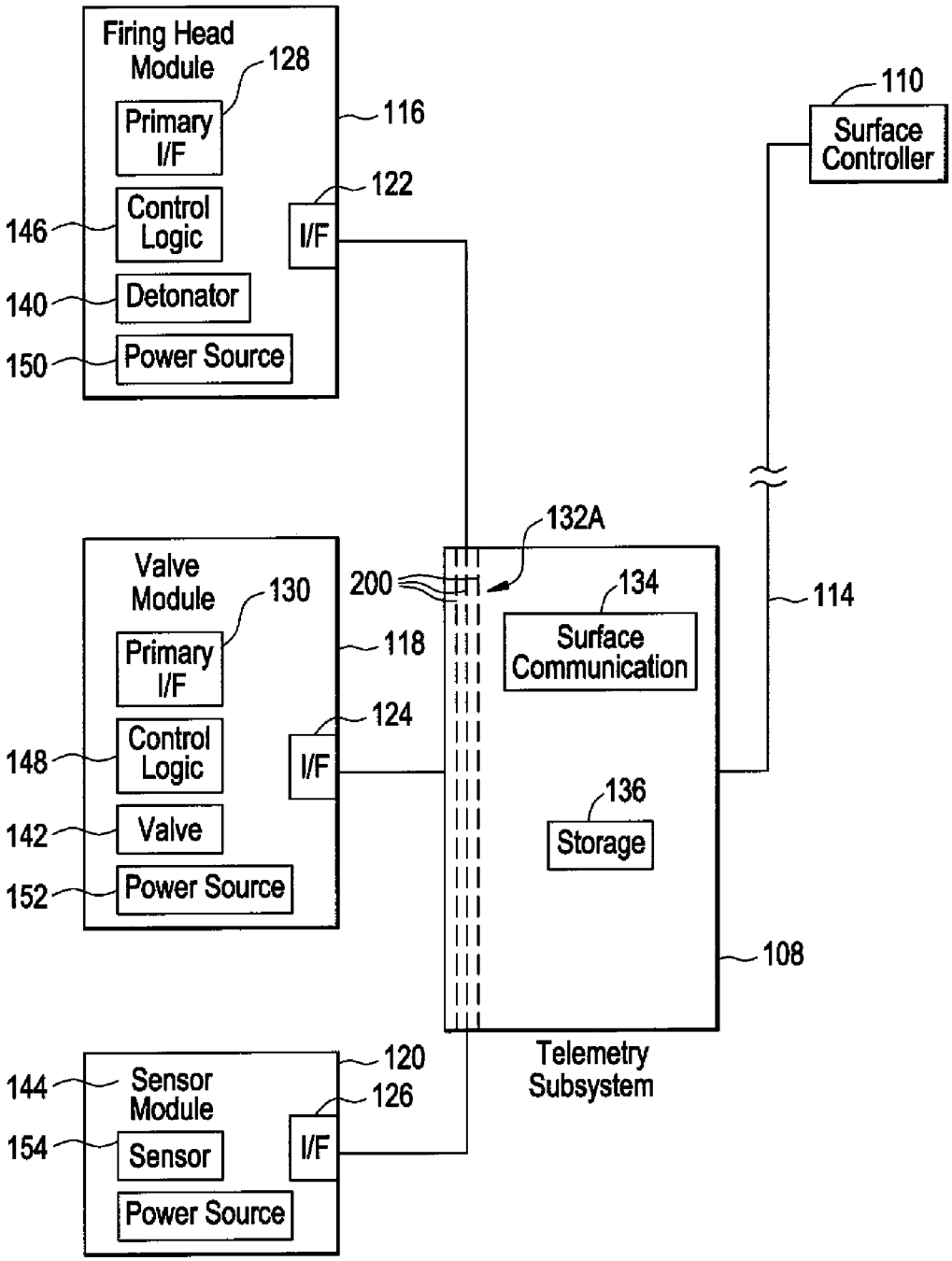
FIG. 3 is a block diagram of an arrangement of modules, according to another embodiment.

In one implementation, the inter-module communication circuitry 132 can include one or more routers, switches, or other telemetry circuitry to allow inter-module communications. In an alternative implementation, as depicted in FIG. 3, the inter-module communication circuitry can be implemented with just a set of wires 200 that directly interconnect the secondary interface circuits 122, 124, and 126. This set of wires 200 that are part of the telemetry subsystem 108 is referred to as inter-module communication circuitry 132A.

Thus, a "telemetry subsystem" can refer to a subsystem that includes routers, switches, and/or other telemetry circuitry to interconnect the downhole modules, or to wires (e.g., electrical wires or optical wires) that interconnect the secondary interface circuits of the downhole modules. Alternatively, "telemetry subsystem" can also refer to a subsystem that enables wireless communication between the secondary interface circuits 122, 124, and 126.

In operation, the ability to communicate between the downhole modules allows for the task performed by one downhole module to be affected by another downhole module. For example, the control logic 146 in the firing head module 116 can send an indication to the valve module 118 when the firing head module 116 has been activated to fire the perforating gun 122. In response to the valve module 118 receiving an indication that the firing head module 116 has been activated, the control logic 148 in the valve module 118 can actuate its valve 142 to set the valve in a predefined position (open or closed or partially open). Thus, generally, at least some of the downhole modules can include control logic to detect for a task performed by another downhole module, where the control logic can affect an operation based on the detection of an indication sent from the other downhole module.

As another example operation, a user at the surface controller 110 (or other surface equipment) can send an activate message downhole through the carrier structure 104. The telemetry subsystem 108 forwards the control message to the firing head module 116 through the secondary interface 122. Upon receipt of the control message by the firing head module 116, the control message can be validated, such as by verifying certain downhole parameters such as pressure and/or temperature. This can be accomplished by the firing head module 116 sending a request through the inter-module communication circuitry 132 to the sensor module 120 to retrieve the desired information from the sensor(s) 144 of the sensor module 120. If the control logic 146 of the firing head module 116 validates that the downhole parameters are within desired ranges, then the control logic 146 can activate the detonator 140 of the firing head module 116 to fire the perforating gun 122.

Also, the firing head module 116 can communicate some status information regarding activation of the firing head module 116 through the telemetry subsystem 108 to the surface controller 110. The firing head module 116 can also cause measured parameters collected from the sensor module 120 to be communicated through the telemetry subsystem 108 to the surface controller 110 so that the user can see the measured downhole parameters when the firing head module 116 was activated.

Note that the sensor module 120 can also include a sensor (such as a casing collar locator) to detect the depth of the tool 102. The control logic 146 of the firing head module 116 can ensure that the tool 102 is at the appropriate depth before allowing activation of the detonator 140.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. A system for use in a wellbore, comprising:

plural modules for positioning in the wellbore and including respective interfaces, wherein the plural modules are configured to perform predefined downhole tasks in the wellbore;

local power sources associated with the plural modules;

a telemetry subsystem comprising one or more telemetry components to interconnect the interfaces of the plural modules to enable communication between at least two of the plural modules, wherein the one or more telemetry components include one or more routers to provide electrical or optical communications between or among the interfaces of the plural modules, and wherein the communication between the at least two of the plural modules allows one of the two modules to affect an operation of another of the two modules; and a carrier structure having embedded conductors coupling the telemetry subsystem to a surface controller.

2. The system of claim 1, wherein a first of the two modules comprises a firing module to fire an explosive device.

3. The system of claim 2, wherein a second of the two modules comprises a valve module.

4. The system of claim 3, wherein the valve module includes control logic to actuate a valve in the valve module in response to an indication of activation of the firing module, wherein the indication is received through the telemetry subsystem.

5. The system of claim 1, wherein the interfaces are secondary interfaces, and wherein multiple ones of the plural modules further include corresponding primary interfaces to communicate with surface equipment located at an earth surface.

6. The system of claim 1, wherein the carrier structure comprises one of a wired tubing and a wired pipe.

7. The system of claim 1, wherein the plural modules comprise a sensor module having at least one sensor to sense a characteristic in the wellbore.

8. The system of claim 7, wherein the plural modules further comprise a firing module having control logic configured to:

receive a command from a surface controller to activate the firing module;

in response to the command, access the sensor module to retrieve measurement data through the telemetry subsystem; and activate the firing module in response to validating the measurement data.

9. The system of claim 8, wherein the control logic of the firing module is configured to further send a status indication to the surface controller.

10. The system of claim 9, wherein the status indication includes the measurement data.

11. The system of claim 1, wherein the local power sources are contained in respective ones of the plural modules.

12. The system of claim 11, wherein the local power sources comprise batteries.

13. The system of claim 1, further comprising the surface controller to be deployed at an earth surface, wherein the surface controller is configured to send commands over the embedded conductors and through the telemetry subsystem to one or more of the modules, and wherein the surface controller is configured to receive data through the telemetry subsystem and over the embedded conductors from one or more of the modules.

14. A method for use in a wellbore, comprising:

positioning plural modules in the wellbore, wherein the plural modules include respective interfaces and respective local power sources, and wherein the plural modules are configured to perform predefined downhole tasks in the wellbore;

providing a telemetry subsystem in the wellbore to enable communication between at least two of the plural modules, wherein the telemetry subsystem comprises one or more telemetry components to interconnect the interfaces of the plural modules, and wherein the one or more telemetry components are selected from one or more routers and one or more switches to enable electrical or optical communications;

communicating information from a first of the plural modules to a second of the plural modules to cause the operation of the second module to be affected by the information from the first module; and communicating data and commands between the telemetry subsystem and a surface controller at an earth surface, wherein communicating the data and commands is through embedded conductors in a carrier structure that carries a tool including the plural modules and the telemetry subsystem.

15. The method of claim 14, wherein the interfaces comprise secondary interfaces that allow the plural modules to communicate with each other through the telemetry subsystem, the method further comprising communicating between multiple ones of the plural modules and surface equipment through a primary interface of each of the multiple modules.

16. The method of claim 14, wherein the first module comprises a firing module, and the second module comprises a valve module, and wherein the information communicated from the first module to the second module comprises the firing module communicating an indication that the firing module has been activated to the valve module, the method further comprising:

the valve module actuating a valve based on the indication from the firing module.

17. The method of claim 14, wherein the second module comprises a firing module, and the first module comprises a sensor module having a sensor to measure a characteristic of the wellbore, wherein the information from the first module to the second module comprises measurement data, the method further comprising:

the firing module validating the measurement data prior to activating the firing module.

18. The method of claim 14, wherein communicating the data and commands comprises sending data sent by one of the plural modules to the surface controller over the embedded conductors.

19. A method for use in a wellbore, comprising:

positioning plural modules in the wellbore, wherein the plural modules include respective interfaces and respective local power sources, and wherein the plural modules are configured to perform predefined downhole tasks in the wellbore;

providing a telemetry subsystem in the wellbore to enable communication between at least two of the plural modules, wherein the telemetry subsystem comprises one or more telemetry components to interconnect the interfaces of the plural modules, and wherein the one or more telemetry components are selected from one or more routers and one or more switches to enable electrical or optical communications;

communicating information from a first of the plural modules to a second of the plural modules to cause the operation of the second module to be affected by the information from the first module; and communicating data and commands between the telemetry subsystem and a surface controller at an earth surface, wherein communicating the data and commands is through an optical fiber contained in tubing.

20. A system for use in a wellbore, comprising:

plural modules for positioning in the wellbore and including respective interfaces, wherein the plural modules are configured to perform predefined downhole tasks in the wellbore;

local power sources associated with the plural modules;

a telemetry subsystem comprising one or more telemetry components to interconnect the interfaces of the plural modules to enable communication between at least two of the plural modules, wherein the one or more telemetry components include one or more routers to provide electrical or optical communications between or among the interfaces of the plural modules, and wherein the communication between the at least two of the plural modules allows one of the two modules to affect an operation of another of the two modules; and a tube containing an optical fiber to couple the telemetry subsystem to a surface controller.

* * * * *